United States Patent [19]

Kappler et al.

[11] Patent Number: 5,003,768

[45] Date of Patent: Apr. 2, 1991

[54] GAS TURBINE INSTALLATION

[75] Inventors: Guenter Kappler; Dieter Rist, both of Munich, Fed. Rep. of Germany

[73] Assignee: Bayerische Motoren Werke Aktiengesellschaft, Munich, Fed. Rep. of Germany

[21] Appl. No.: 480,377

[22] Filed: Feb. 14, 1990

Related U.S. Application Data

[63] Continuation of Ser. No. 285,018, Dec. 16, 1988, abandoned.

[30] Foreign Application Priority Data

Dec. 17, 1987 [DE] Fed. Rep. of Germany ..... 3742891

[51] Int. Cl.[5] ..... F02C 7/057

[52] U.S. Cl. ..... 60/39.23; 60/723

[58] Field of Search ..... 60/723, 39.23, 39.06, 60/39.822; 431/7, 328, DIG. 1

[56] References Cited

U.S. PATENT DOCUMENTS

| | | | |
|---|---|---|---|
| 3,846,979 | 11/1974 | Pfefferle | 60/39.23 |
| 3,940,923 | 3/1976 | Pfefferle | 60/39.06 |
| 3,958,413 | 5/1976 | Cornelius et al. | 60/39.23 |
| 3,982,879 | 9/1976 | Pfefferle | 431/10 |
| 4,047,877 | 9/1977 | Flanagan | 60/723 |
| 4,263,780 | 4/1981 | Stettler | 60/39.23 |
| 4,731,989 | 3/1988 | Furuya et al. | 60/723 |

FOREIGN PATENT DOCUMENTS

| | | | |
|---|---|---|---|
| 7722 | 1/1984 | Japan | 60/723 |

*Primary Examiner*—Louis J. Casaregola
*Assistant Examiner*—Timothy S. Thorpe
*Attorney, Agent, or Firm*—Evenson, Wands, Edwards, Lenahan & McKeown

[57] ABSTRACT

In order to achieve in connection with gas turbine installations which are to be used preferably as motor vehicle drive, a combustion low in harmful components, a two-stage combustion chamber with catalytic combustion in the first stage is proposed. The second stage has the task to ready the necessary additional energy during acceleration- and full-load operation.

30 Claims, 2 Drawing Sheets

GAS TURBINE INSTALLATION

This is a continuation of application Ser. No. 07/285,018 filed Dec. 16, 1988, now abandoned.

BACKGROUND AND SUMMARY OF THE INVENTION

The present invention relates to a gas turbine installation, especially for the drive of motor vehicles, with a combustion chamber for producing the operating medium of the output turbine, whereby the combustion chamber is constructed as two-stage combustion chamber with catalytic combustion in the first stage constructed as head combustion chamber, as well as to a method for operating such a gas turbine installation.

In the prior art design of combustion chambers for gas turbines which are to be used in motor vehicles, especially in passenger motor vehicles, one has placed heretofore a value only on achieving a high combustion degree and a uniform temperature distribution.

By reason of more strict legal regulations in the exhaust gas sector of internal combustion engines, an increased attention must now be paid also in connection with the construction of gas turbines and in particular of the combustion chambers thereof to the prescribed harmful materials emission limits. The influencing magnitudes to be taken into consideration in the design which are determinative for the harmful material generation, result from the analysis of the reaction-kinetic processes in the combustion chamber. The most important influencing magnitudes are thereby the primary zone temperature and the equivalence ratio, the degree of the pre-mixing and of the combustion homogeneity in the primary zone, the dwell of the combustion products in the primary zone, the "freezing-in" of the reaction products in wall proximity of the combustion chamber and the intermediate zone temperature and dwell.

The difficulty of the design of combustion chambers low in emission of harmful materials consists in the contradictory effect of the influencing magnitudes on the individual harmful material components. Thus, for example, low primary zone temperatures lead to a low NO-emission, however, at the same time, to a high CO-concentration by reason of the reduced oxidation rate.

In order to solve these problems, it is known from the EP-A 0 144 094 to provide a catalytically assisted combustion in that a catalyst has been provided in the combustion chamber. By reason of the catalytically assisted combustion, the fuel oxidation can be displaced beyond the flame-out limit into very lean fuel-air ratios and low reaction temperatures. Thus, a possibility exists to reduce at the same time the NO-and CO-emission without loss in the power output yield or an increase in the fuel consumption. Liquid or gaseous hydrocarbons, carbon suspensions and hydrogen may be used as fuels in the combustion chamber.

It is the object of the present invention to provide for a gas turbine installation of the aforementioned type a space-saving construction.

The underlying problems are solved according to the present invention in that the combustion chamber is constructed as annular combustion chamber with a catalyst constructed as ring. The advantage of this solution resides in that compact dimensions of the entire installation are achieved because all feed lines for the second stage of the combustion chamber can be laid out into the annular space. The combustion air for the second stage thereby exerts a cooling action.

The flow constriction between the first and second stage in the direction toward the second stage offers the advantage that flashbacks or backfirings out of the second stage of the combustion chamber are avoided thereby.

A preferred feed possibility of the fuel into the first stage of the combustion chamber which assures a good and rapid mixing with the air is realizable according to the present invention in that the fuel is supplied to the first stage by way of a pre-evaporator. The pre-evaporator or pre-evaporators is or are thereby to be so designed and constructed that it or they effect a small pressure loss and assure an adequate hold-up or dwell time for the nearly complete evaporation of the fuel.

According to another feature of the present invention, the combustion chamber of the first stage is made up of a pre-mixing zone according to the diffusion burner principle and of a combustion zone with catalyst, in this sequence as viewed in the flow direction of the air. This offers the advantage that the already evaporated fuel is thereby mixed homogeneously with the air. A non-uniform mixing is prevented thereby so that no local fuel enrichments can take place which, upon reaching stoichiometric ratios, lead to the formation of flashbacks or flame backfirings into the altogether lean fuel-air mixture. The design of the mixing zone according to the principle of the diffusion burner therebeyond offers the advantage that the mixing periods are limited below the ignition delays.

If, according to another feature of the present invention, the catalyst is made up of several ring-shaped individual disk segments, then it is possible to create a catalyst constructed and to be manufactured in a simple manner which satisfies the requirements for a complete combustion while assuring at the same time a reduction of the NO- and CO-emission by means of a simple construction.

A preferred arrangement of the catalyst involves an arrangement in which at first the segments with low reaction temperature and then following the segments with high reaction temperature are provided, as viewed in the flow direction of the fuel-air mixture. By reason of the progressive temperature increase in the fuel oxidation, the first catalyst segments are so constructed that they become active at low reaction temperatures. The adjoining catalyst segments have a high oxidation effect so that the reaction temperature and therewith the air heat-up is increased.

According to still another feature of the present invention, the segments of the catalyst consist of a substrate with an intermediate adhesive layer and a catalyst layer applied thereon. Catalyst segments which are so constructed, can be manufactured economically. They are characterized by a support structure which consists of a substrate as well as of an intermediate adhesive layer on which the catalyst is applied by evaporation. The substrate may thereby consist of alloys of magnesium, aluminum and titanium while materials from the material group of platinum are provided as catalyst material.

The porosity of the substrate is so selected that the pressure loss remains small. For that purpose, each catalyst segment has at least fifty cells/cm$^2$. A pressure loss in the combustion chamber is achieved thereby which is no greater than 5%.

For purposes of controlling the combustion in the second stage of the combustion chamber, it is proposed according to another feature of the present invention that the second stage of the combustion chamber be provided with controllable and adjustable air inlet openings. A controlled afterburning for the adjustment of maximum process temperatures is achieved therewith.

As the combustion chamber is constructed as annular combustion chamber, the space disposed in the longitudinal axis can be utilized for additional components. According to still another feature of the present invention, the control of the air inlet openings may thereby consist of an adjusting motor with adjusting members arranged in the longitudinal axis of the annular combustion chamber. A cooling and a heat insulation with respect to the hot walls of the combustion chamber is created thereby by the air itself. The fuel lines to the second stage of the combustion chamber may also be arranged at this location without the need to provide additional heat insulation measures, without which the fuel would evaporate in its lines so that deposits might then form which would lead to a clogging up of the lines.

By reason of the proposed combustion chamber geometry, also an adequate support for the adjusting motor and the actuating members is provided thereby so that an exact control of the air inlet openings combined with great length of life of the actuating members and of the adjusting motor is achieved therewith.

Two alternative possibilities for the control of the air inlet openings exist according to the present invention. According to one embodiment, the size of the air inlet opening is determined by a rotatable apertured ring. According to another embodiment of the present invention, the size of the inlet opening is determined by a displaceably arranged ring. A simplification—without negative influencing of the combustion in the second stage of the combustion chamber—of the control of the air inlet opening is possible according to the present invention in that the air inlet openings are arranged along the inner and outer circumference of the second stage of the combustion chamber and only the inner inlet openings are provided with a ring (apertured ring).

In order to achieve a good atomization, it is additionally proposed according to the present invention that at least one air-assisted atomization nozzle be provided for supplying the fuel in the second stage. The preferred location of the ignition devices according to the present invention is thereby the arrangement of a spark plug in direct proximity of the atomization nozzle.

A preferred method of operating the gas turbine installation with the combustion chamber constructed in accordance with the present invention resides in initiating the combustion in the second stage for starting the combustion machine. The control of the air supply in the second stage of the combustion chamber is thereby carried out as a function of the air requirement in the catalyst. Furthermore, during the acceleration and at full load, the power output of the second stage of the combustion chamber is increased. Thus, by reason of the construction of the two-stage combustion chamber, the combustion for the starting can be initiated in the combustion chamber itself and the catalyst can be heated up from behind, so to speak of. This takes place very rapidly so that already a short period of time after the start the fuel, oxidation in the first stage of the combustion chamber can be initiated.

By controlling the air supply in the second stage of the combustion chamber in dependence on the air requirements in the catalyst, it is achieved that the temperature increase in the combustion chamber can be controlled in order to achieve optimum combustion efficiency.

In order to achieve acceleration values of the gas turbine similar to the reciprocating piston engine as well as to cover power output peaks, the second stage is also suitable because the power output of the second stage of the combustion chamber can be increased for that purpose according to the present invention.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
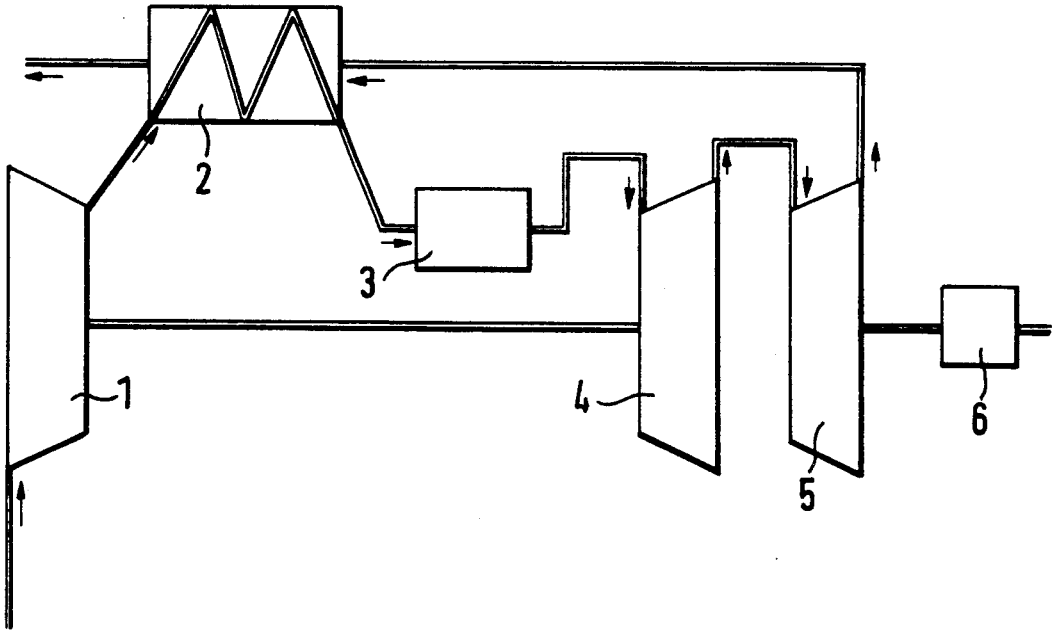
FIG. 1 is a schematic view of the construction of a gas turbine installation for motor vehicles in accordance with the present invention.

Referring now to the drawing wherein like reference numerals are used throughout the two views to designate like parts, a two-shaft-gas turbine installation is schematically illustrated in FIG. 1 as an example. It consists in a known manner of the compressor 1, the heat-exchanger 2, the combustion chamber 3, the compressor turbine 4, as well as the work or output turbine 5. A speed-reduction gear 6 of conventional construction is arranged at the output shaft of the work turbine 5 whereby the output shaft of the speed-reduction gear—with the use of the gas turbine installation in a motor vehicle—is connected with the motor vehicle transmission.

The compressor 1 sucks-in atmospheric air and conducts the same through the heat-exchanger 2 which is traversed by the heated-up exhaust gases after leaving the work turbine 5. The thus-compressed and heated air is conducted to the combustion chamber 3 where it experiences a further temperature increase with the assistance of fuel. It is then conducted to the compressor turbine 4 for the drive of the compressor 1 and to the work turbine 5 for the drive of the reduction gear 6, from where it is conducted into the atmosphere after flowing through the heat-exchanger 2 and eventually through silencing devices.

Figure 2:
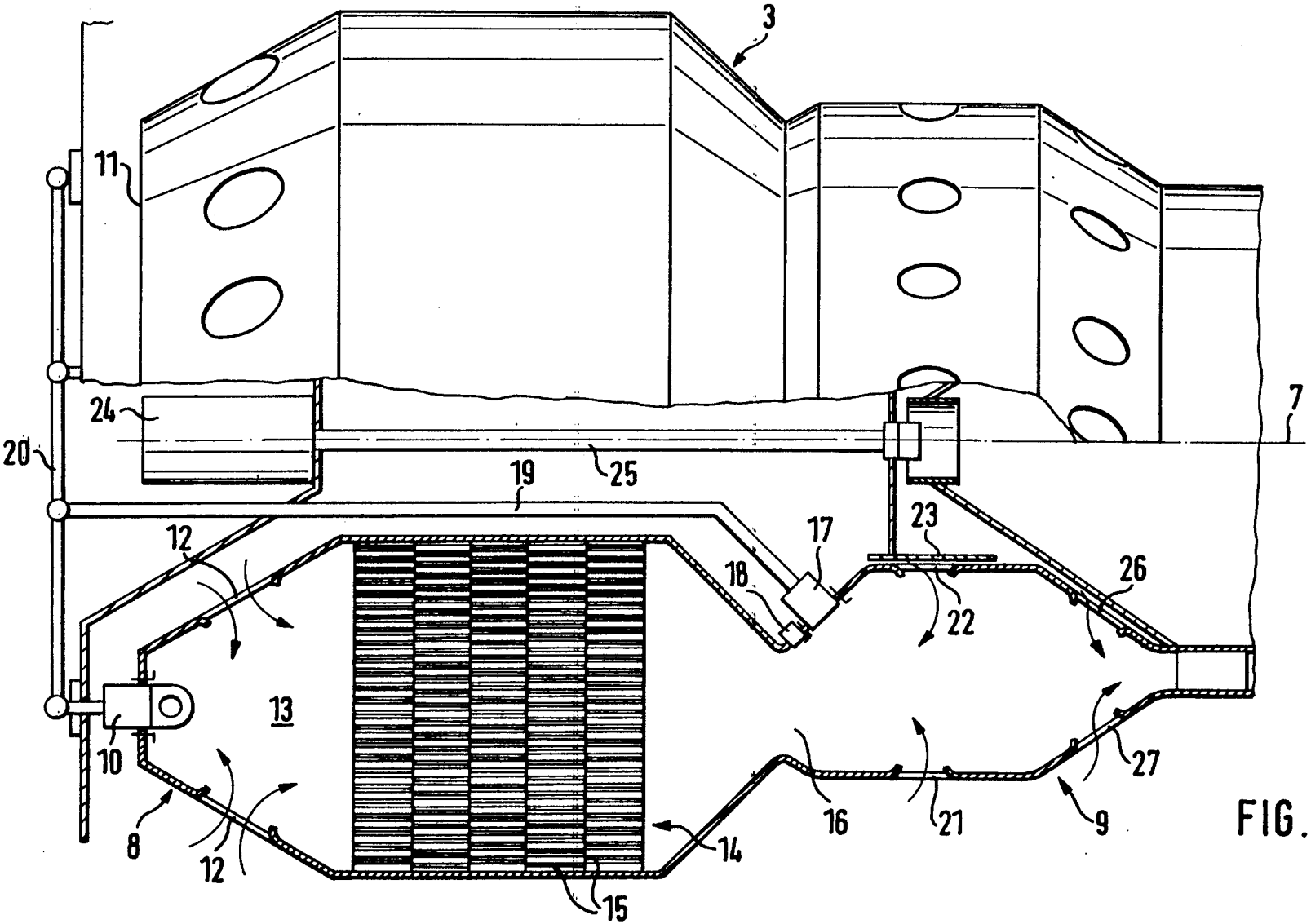
FIG. 2 is a longitudinal view, partly in longitudinal cross section, of the combustion chamber constructed in accordance with the present invention.

In order to be able to operate such a gas turbine installation with maximum process temperatures and low harmful material emission as well as with optimum start and full-load as well as acceleration conditions, the combustion chamber according to the present invention illustrated in FIG. 2 is provided.

FIG. 2 illustrates in the upper half a side view and in the lower half a schematic cross-sectional view through the combustion chamber generally designated by reference numeral 3 and constructed in accordance with the present invention. The combustion chamber 3 is constructed as two-stage head-type annular combustion chamber with a longitudinal axis 7 and the two stages 8 and 9. The first stage 8 is constructed as main combustion chamber. The fuel is supplied by way of pre-evaporators 10 which are arranged distributed star-shaped on the outer end face 11. The air necessary for the fuel oxidation which is compressed by the compressor 1 and heated by way of the heat-exchanger 2, flows into the combustion chamber by way of air inlet openings 12 which are arranged on the circumference of the first stage 8 constructed diffusor-like. Air and evaporated fuel mix in the pre-mixing zone 13 into a homogeneous mixture whereby the mixing periods remain below the ignition delays by reason of the design of the main combustion chamber.

The vaporous fuel-air mixture then reaches the catalyst generally designated by reference numeral 14 which is built up of individual ring-shaped segments 15 arranged coaxially to the longitudinal axis 7. As a result thereof, a catalysis is effected in stages. At the inlet of the fuel-air mixture segments 15 are used which are active at low reaction temperatures. Further segments 15 of high oxidation effectiveness adjoin the same in which the reaction temperature and therewith the air heat-up increases. These catalytic segments are secured in support structures and consist of a substrate as well as of an intermediate adhesive layer on which the catalyst materials selected from the working material group of platinum are evaporated. By reason of the high operating temperatures of about 1,450° K., high demands are made of the materials. The porosity of the substrate, for which one utilizes alloys of magnesium, alluminum and titanium, is so selected that the pressure loss is small. One can achieve a pressure loss of the entire combustion camber of no more than 5% if the substrate structure has at least fifty cells/$cm^2$.

The reaction products flow out of the catalyst 14 through the flow constriction 16 into the second stage 9 of the combustion chamber 3. The flow constriction 16 has the task to prevent flashbacks out of the second stage of the combustion chamber into the catalyst which would lead to its unavoidable destruction.

The fuel is introduced into the second stage 9 of the combustion chamber 3 with the aid of air-assisted atomization nozzles 17. The spark plugs 18 for the ignition of the fuel-air mixture present in the second stage 9 are provided adjacent the atomization nozzles 17. By reason of the construction of the annular combustion chamber, the atomization nozzles 17 are arranged on the inner wall of the combustion chamber and are supplied with fuel by way of fuel feed lines 19 located inside of the annular combustion chamber. The fuel lines 19 branch off from the main fuel line 20, with which are connected the pre-evaporators 10.

The second stage 9 of the combustion chamber 3 includes air inlet openings 21 and 22 arranged distributed along its circumference whereby the air inlet openings 21 are arranged on the outside and the air inlet openings 22 on the inside of the annularly shaped head-type combustion chamber. For the control of the air supply into the second stage of the combustion chamber, the inner air inlet openings 22 are provided with an apertured ring 23 which can be rotated by an adjusting motor 24 by way of actuating members 25. Both the adjusting motor 24 as also the actuating members 25 can be arranged coaxially to the longitudinal axis 7 of the combustion chamber. Separate heat-insulating means are thereby not necessary when the interior space surrounded by the annular combustion chamber is cooled by reason of the supplied air.

Further air inlet openings 26 and 27 on the inner, respectively, outer circumference of the combustion chamber are arranged distributed at the outlet of the second stage of the combustion chamber 9, as viewed in the flow direction of the reaction products. The required temperature profile at the combustion chamber outlet, especially in the wall area thereof can be influenced by these air inlet openings 26 and 27.

For purposes of starting the gas turbine installation, fuel is conducted by way of the lines 20 and 19 to the air-jacketed atomization nozzles 17. At the same time, the compressor turbine is accelerated by way of a corresponding starter unit so that compressed and moderately heated air can flow by way of the still cold heat-exchanger to the air inlet openings 12 as well as 21, 22 and 26, 27 into the first and second stage of the combustion chamber. As the apertured ring 23 is so adjusted for the starting of the gas turbine installation that the maximum opening cross section air inlet opening 22 is opened up, a combustible mixture can form thereat which is ignited by way of the ignition device 18. The combustion initiated thereat effects a heat-up of the catalyst segments 15 and at the same time supplies heated-up reaction products which further heat-up the compressed air supplied by the compressor 1 in the heat-exchanger 2.

As soon as the catalyst 14 has reached its operating temperature, fuel is introduced into the first stage 8 of the combustion chamber by way of the pre-evaporators 10. The combustion chamber supplies therewith reaction products which can drive both the compressor turbine 4 as also the work turbine 5. The combustion is cut back in the second stage 9 of the combustion chamber after the start of the gas turbine unit in that the apertured ring 23 is so rotated that the air inlet openings 22 close. However, a slight amount of fuel is continued to be fed through the air-jacketed atomizing nozzles 17 so that a type of pilot flame is maintained thereat.

For accelerating the vehicle driven by the gas turbine unit, the air supply is again increased in the second stage of the combustion chamber 3 by way of the apertured ring 23 as well as the fuel supply by way of the atomizing nozzles 17 so that a noticeable afterburning takes place thereat and therewith a marked temperature increase. This is also carried out at full load.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A gas turbine installation operating on a two-stage combustion process, comprising:

a combustion chamber;

a compressor for providing a source of air to the combustion chamber;

a compressor drive turbine for driving the compressor;

a work turbine driving a rotary output shaft;

the combustion chamber burning fuel in the compressed air received from the compressor, being located downstream therefrom and upstream of the turbines, and being constructed as a two-stage combustion chamber with a catalyst having a ring shape for catalytic combustion in a first upstream stage connected to the compressor and a flame combustion in an annular stage downstream from the catalytic stage for burning fuel at a higher temperature than a temperature in the catalytic stage;

an interior wall of the downstream annular stage defining a closed surface except for air inlet openings which are selectively opened and closed;

the compressor providing compressed air for the second combustion state that by-passes the first combustion stage; and a fuel supply for the second combustion stage;

wherein said air and fuel supply are located within an area defined by an inner wall of the downstream annular stage of the combustion chamber.

2. A gas turbine installation according to claim 1, wherein a flow constriction is provided between the upstream and the downstream annular combustion stages.

3. A gas turbine installation according to claim 1, wherein fuel is fed into the upstream annular stage by way of pre-evaporator means.

4. A gas turbine installation according to claim 1, wherein the combustion chamber of the upstream stage includes a premixing zone configured to constitute a diffusion burner and followed by a combustion zone with the catalyst, as viewed in the flow direction of the compressed air.

5. A gas turbine installation according to claim 1, wherein the catalyst is made up of several ring-shaped individual segments.

6. A gas turbine installation according to claim 5, wherein the catalyst has a first ring of individual segments that operates at a first set of reaction temperatures and is followed by at least one second ring of individual segments that operates at a second set of reaction temperatures higher than the first set, as viewed in the flow direction of the fuel-air mixture.

7. A gas turbine installation according to claim 6, wherein the segments include a substrate with an intermediate adhesive layer and a catalyst layer applied thereon.

8. A gas turbine installation according to claim 7, wherein the substrate consists of alloys of magnesium, aluminum and titanium.

9. A gas turbine installation according to claim 7, wherein platinum compounds are provided as the catalyst.

10. A gas turbine installation according to claim 5, wherein each catalyst segment has at least fifty cells/$cm^2$ for purposes of low pressure losses.

11. A gas turbine installation according to claim 1, wherein the downstream annular stage of the combustion chamber has controllable and adjustable air inlet openings.

12. A gas turbine installation according to claim 11, further comprising control means for the air inlet openings including an adjusting motor with actuating members arranged along a longitudinal axis of the annular combustion chamber.

13. A gas turbine installation according to claim 12, wherein the size of the air inlet openings is determined by a rotatable apertured ring.

14. A gas turbine installation according to claim 12, wherein the size of the air inlet openings is determined by a ring selectively displaceable with respect to the air inlet openings.

15. A gas turbine installation according to claim 1, wherein air inlet openings are arranged along an inner and outer circumference of the downstream annular stage of the combustion chamber and only the inner air inlet openings are provided with a displaceable ring.

16. A gas turbine installation according to claim 1, wherein at least one air-assisted atomizing nozzle means is provided for delivering the fuel into the downstream annular stage.

17. A gas turbine installation according to claim 16, wherein a spark plug means is arranged in direct proximity of the atomizing nozzle means.

18. A gas turbine installation according to claim 2, wherein fuel is fed into the upstream stage by way of pre-evaporator means.

19. A gas turbine installation according to claim 18, wherein the combustion chamber of the upstream stage includes a premixing zone configured to constitute a diffusion burner and followed by a combustion zone with the catalyst, as viewed in the flow direction of the air.

20. A gas turbine installation according to claim 19, wherein the upstream annular stage of the combustion has controllable and adjustable air inlet openings.

21. A gas turbine installation according to claim 20, further comprising control means for the air inlet openings including an adjusting motor with actuating members arranged along a longitudinal axis of the annular combustion chamber.

22. A gas turbine installation according to claim 20, wherein air inlet openings are arranged along an inner and outer circumference of the downstream annular stage of the combustion chamber and only the inner air inlet openings are provided with a displaceable ring.

23. A gas turbine installation according to claim 22, wherein at least one air-assisted atomizing nozzle means is provided for delivering the fuel into the upstream stage.

24. A gas turbine installation according to claim 23, wherein a spark plug means is arranged in direct proximity of the atomizing nozzle means.

25. A gas turbine installation according to claim 24, wherein the catalyst is made up of several ring-shaped individual segments.

26. A gas turbine installation according to claim 25, wherein the catalyst has a first ring of individual segments that operate at a first set of reaction temperatures and is followed by at least one ring of individual segments that operates at a second set of reaction temperatures higher than the first set, as viewed in the flow direction of the fuel-air mixture.

27. A gas turbine installation according to claim 1, wherein combustion initiating means are provided in the second downstream burner stage for starting combustion in the two-stage combustion chamber.

28. A gas turbine installation according to claim 27, further comprising air controlling means for controlling air supplied to the downstream annular stage of the combustion chamber in dependence on the air requirement in the catalyst.

29. A gas turbine according to claim 28, wherein the fuel supply means provides additional fuel to the downstream annular stage of the combustion chamber during acceleration and at full load.

30. A gas turbine installation according to claim 27, wherein the fuel supply means provides additional fuel to the downstream annular stage of the combustion chamber during acceleration and at full load.

* * * * *